US006872900B1

(12) United States Patent
Lament et al.

(10) Patent No.: US 6,872,900 B1
(45) Date of Patent: Mar. 29, 2005

(54) DOUBLE THROW SWITCH LINKAGE

(75) Inventors: Tod Taylor Lament, West Liberty, OH (US); Dan Alan Fisher, Columbus, OH (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/798,685

(22) Filed: Mar. 11, 2004

(51) Int. Cl.[7] ..... H01H 9/26
(52) U.S. Cl. ..... 200/50.32
(58) Field of Search ..... 200/50.01, 50.32–50.4

(56) References Cited

U.S. PATENT DOCUMENTS

| | | | | | |
|---|---|---|---|---|---|
| 2,368,083 | A | | 1/1945 | Adam | 200/18 |
| 2,531,157 | A | | 11/1950 | Pifke | 200/50 |
| 3,303,300 | A | * | 2/1967 | Turnbull | 200/50.33 |
| 3,401,364 | A | | 9/1968 | Whiting | 335/160 |
| 4,034,170 | A | | 7/1977 | Raabe et al. | 200/50 |
| 4,103,133 | A | | 7/1978 | Erickson et al. | 200/153 |
| 4,598,264 | A | | 7/1986 | Suter | 335/161 |
| 4,724,512 | A | | 2/1988 | Bischof et al. | 361/357 |
| 4,886,311 | A | * | 12/1989 | Trube et al. | 200/17 R |
| 4,924,041 | A | * | 5/1990 | Yee | 200/50.33 |
| 5,725,085 | A | | 3/1998 | Seymour et al. | 200/50.33 |
| 6,043,439 | A | * | 3/2000 | Crooks et al. | 200/50.33 |
| 6,194,675 | B1 | | 2/2001 | Greer | 200/50.32 |
| 6,320,143 | B1 | | 11/2001 | Greer | 200/50.33 |

* cited by examiner

*Primary Examiner*—Michael A. Friedhofer
(74) *Attorney, Agent, or Firm*—Foley & Lardner LLP

(57) ABSTRACT

A double throw switch linkage for coupling two switch apparatuses together in an enclosure. Each switch apparatus is coupled to the switch mechanism having a switch mechanism lever arm. When the lever arm is moved it translates a force to the actuator plate which closes one switch mechanism and maintains the other switch mechanism in an open position.

14 Claims, 2 Drawing Sheets

DOUBLE THROW SWITCH LINKAGE

BACKGROUND OF THE INVENTION

The present invention is directed to linkages for controlling switches and more particularly to a linkage for use as a double throw switch for controlling two switches mounted in the same enclosure so that only one switch can be on at any given time.

Switching apparatus generally referred to as a double throw switch is commonly used to alternatively connect one of two load devices to a source of electric power or to connect a single load device alternatively to one of two separate sources of electric power. For example, two lines coming into a switch tied to one load coming out of the switch as in a system that has an emergency power generator to switch from normal power source to the emergency generator. Another example is one line coming into a switch tied to two loads coming out of the switch as in a system that has a backup pump that needs to operate when the main pump is off line. The two switch mechanisms are tied together with a linkage. The linkage allows only one switch to be turned on at a time. Prior linkages typically are assembled using multiple slots in a plate which is secured to a framework by multiple fasteners or rivets which slide in the plurality of slots.

There is a need for a double throw switch linkage that requires fewer parts for assembly thereby reducing costs and complexity.

SUMMARY OF THE INVENTION

There is provided a double throw switch linkage for coupling two switch apparatuses together and in an enclosure. Each switch apparatus is coupled to a switch mechanism having a switch mechanism lever arm. The double throw switch linkage comprises an actuator plate slidingly mounted to a sidewall of the enclosure with fasteners through a plurality of actuator plate slots defined in the actuator plate. The actuator plate also defines a first switch slot, a second switch slot, and a driver arm slot. Each switch slot is configured to guide a pin mounted on each switch mechanism lever arm. A lever arm assembly is mounted on a sidewall of the enclosure. The lever arm assembly includes a lever arm coupled to a driver arm, with the driver arm configured to engage the driver arm slot in the actuator plate. When the lever arm is moved, it translates a force to the actuator plate which closes one switch apparatus and maintains another switch apparatus in an open position. In another embodiment of the double throw switch linkage, the actuator plate is composed of two members coupled together with the lever arm assembly.

There is also provided an electric double switch comprising an enclosure having at least one sidewall, a bottom wall and a cover. A first switch apparatus, including a first switch mechanism having a lever arm is mounted in the enclosure. A second switch apparatus, including a second switch mechanism having a lever arm, is mounted in the enclosure. A double throw switch linkage is coupled to each of the first and second switch apparatus. The double throw switch linkage comprises an actuator plate slidingly mounted to the sidewall of the enclosure with fasteners through a plurality of actuator plate slots defined in the actuator plate. The actuator plate also defines a first switch slot, a second switch slot and a driver arm slot, with each switch slot configured to guide a pin mounted on each switch mechanism lever arm. A lever arm assembly is mounted on the sidewall of the enclosure. The lever arm assembly includes a lever arm coupled to a driver arm, with the driver arm configured to engage the driver arm slot in the actuator plate. Upon movement of the lever arm, the lever arm translates a force to the actuator plate which closes one switch apparatus and maintains the other switch apparatus in an open position.

Also provided is a method for interlocking two switch apparatus mounted in an enclosure. Each switch apparatus has a switch mechanism including a switch mechanism lever arm and the enclosure has a cover and a sidewall. The method comprises the steps of providing an actuator plate, with the actuator plate defining a first switch slot, a second switch slot and a driver arm slot. Each switch slot is configured to guide a pin mounted on each switch mechanism lever arm. Mounting the actuator plate, for sliding movement, on the sidewall of the enclosure. Aligning the pin on each switch mechanism arm in one of the first and second switch slots in the actuator plate. Mounting a lever arm assembly on the sidewall of the enclosure, with the lever arm assembly including a lever arm coupled to a driver arm. Aligning the driver arm to engage the driver arm slot in the actuator plate. Moving the lever arm to translate a force to the actuator plate wherein one switch apparatus is closed and the other switch apparatus is maintained in an open position. The actuator plate can be two members coupled together by the lever arm assembly. An alternative embodiment for the method includes the step of providing an interlock release mechanism coupled to the cover and the interlock housing, wherein the cover can be opened if one of the switch apparatus is closed.

DETAILED DESCRIPTION OF EXEMPLARY EMBODIMENTS

Figure 1:
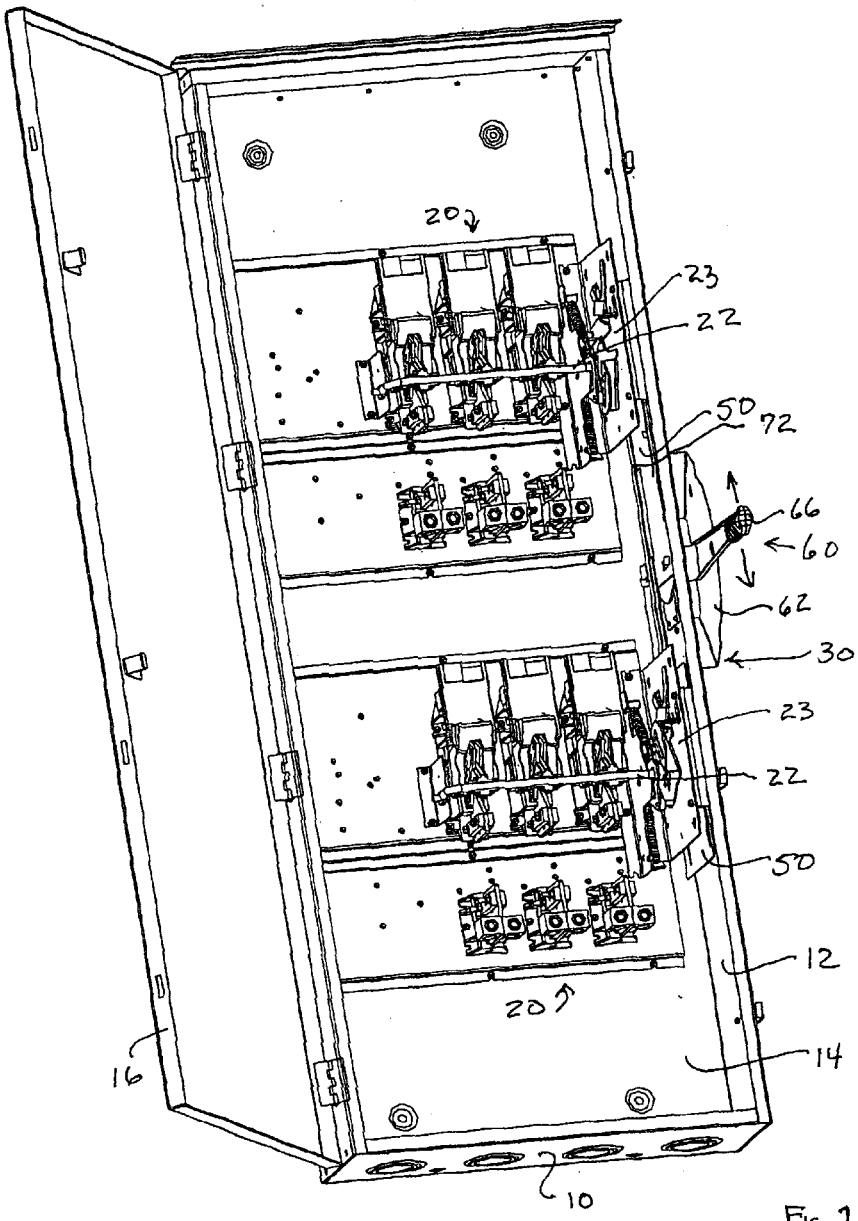
FIG. 1 is a perspective view of an alternative exemplary embodiment of an electrical enclosure housing two switch apparatus coupled to an alternative exemplary embodiment of a double throw switch linkage.

Referring to the figures, FIG. 1 illustrates an exemplary embodiment of a double throw switch linkage 30 mounted in an enclosure 10 and coupled to a pair of switch mechanisms 22. Each switch mechanism 22 is coupled to a switch apparatus 20 with a switch mechanism interface 23. The enclosure 10 typically includes sidewalls 12, a bottom wall 14 and a cover 16. The switch apparatus 20, typically are configured for multiple phase connections and can be rated in the range of 400 to 1200 amps. In such cases, the enclosures typically are North American Electrical Manufacturers Association (NEMA) Type 1 and 3R. It is contemplated, that other current rating and enclosure configurations can be suitable for the double throw switch linkage disclosed herein.

A double throw switch is actually two switch apparatus 20 combined in a single enclosure 10. The switch mechanisms 22 are coupled together with a double throw switch linkage 30. The double throw switch linkage 30 allows only one switch to be turned on at any given time.

A typical operating sequence for a double throw switch mechanism provides that the lever arm 66 of a lever arm assembly 60 is positioned in an "OFF" position which typically is a mid-point between the two "ON" positions. In such position, both switch apparatus 20 are "OFF". If an operator, for example, moves the lever arm 66 in one direction (indicated by the arrows in FIG. 1) one of the switch apparatus 20 will be closed and energized. The lever arm 66 is typically at the upper limit of the handle throw, for example in FIG. 1, lever 66 would be moved in the direction towards the top of FIG. 1. An operator moves the lever arm 66 back to the mid or "OFF" position, the first switch would be in the open or "OFF" position. When the operator would move the handle 66 to a second position (in the direction of the bottom of FIG. 1) the second switch apparatus 20 would be closed or energized and the first switch apparatus 20 would still be in the "OFF" position. By moving the lever arm 66 back to the mid point position, the second switch apparatus 20 would be returned to the "OFF" position.

Figure 2:
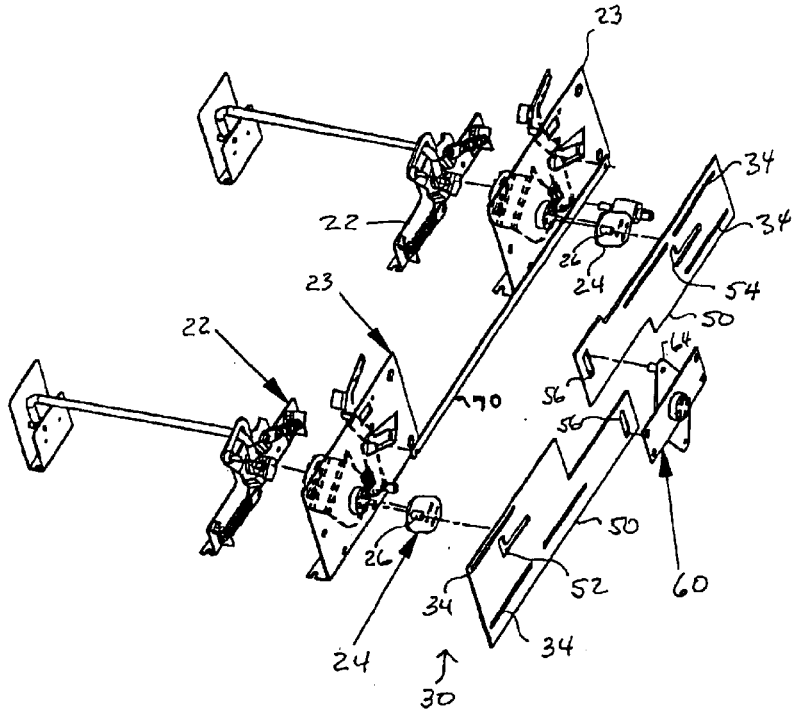
FIG. 2 is an exploded perspective view of the double throw switch linkage illustrated in FIG. 1.

Referring to FIGS. 1 and 2, there is illustrated an exemplary embodiment of a double throw switch linkage 30.

A switch mechanism lever arm 24 is coupled to each switch mechanism 22. A typical coupling includes two screws to mount the switch mechanism lever arm 24. Each switch mechanism lever arm includes a switch mechanism lever arm pin 26.

An actuator plate 50 is slidingly mounted on a side wall 12 of the enclosure 10. The actuator plate 50 defines a first switch slot 52 and a second switch slot 54. Each switch slot 52, 54 is proximate each end of the actuator plate 50 and is aligned with the switch mechanism lever arm pin 26. A typical configuration for each switch slot 52, 54 is L-shaped slot. The actuator plate 50 also defines a driver arm slot 52 which is located proximate the midpoint of the actuator plate 50. It should be understood that its location is defined by the relative lateral motion required to actuate the double throw switch linkage 30 to have one switch apparatus 20 open and the other switch apparatus 20 closed.

A lever arm assembly 60 is mounted on a sidewall 12 of the enclosure 10. (See FIG. 1.) The lever arm assembly 60 includes a lever arm 66 (also referred to as an operating handle) coupled to a driver arm 64. The driver arm 64 is configured to engage the driver arm slot 56 in the actuator plate 50.

When the lever arm 66 is moved by an operator (as shown by the arrows in FIG. 1) a force is applied to the actuator plate 50 by the driver arm 64 which moves the actuator plate 50. As the actuator plate 50 is moved, the switch mechanism lever arm pin 26 follows in the actuator plate slot 52, 54 thereby rotating the switch mechanism lever arm 24 and actuating the switch mechanism 22. Because of the actuator plate slot 34 configuration, one of the switch apparatus 20 will be closed (energized) and the other one will be maintained in an open position (unenergized) upon movement of the actuator plate 50 to the end of its stroke.

An interlock release mechanism 70 is configured to release the cover 16 interlocks so that the cover 16 can be opened with either of the switch apparatus 20 in the "ON" position. An interlock release linkage may be coupled to an interlock release bar which engages the cover 16 interlocks.

As illustrated in FIGS. 1–2, the actuator plate 50 is two separate members. The actuator plate 50 can be composed of a material selected from a group including a metal, such as steel, a plastic, a composite material, or any two of such materials. In any event, the material used for the actuator plate 50 should be of a strength and composition that is sufficient and suitable for the mechanical forces exerted upon the actuator plate 50 and the electrical ratings of the switch apparatus 20.

As illustrated in FIGS. 1 and 2, a double throw switch linkage 30, slidingly mounts two actuator plates 50 to a sidewall 12 of the enclosure 10. Fasteners, which may include bearings fasten the actuator plate 50 to the sidewall 12 through a plurality of actuator plate slots 34 defined in the actuator plate 50.

The lever arm assembly 60 is mounted on the sidewall 12 of the enclosure 10. The lever arm assembly 60 includes a lever arm 66 coupled to the driver arm 64 with the driver arm 64 configured to engage each driver arm slot 56 in each of the actuator plates 50 (See FIG. 2).

Thus there has been disclosed a double throw switch linkage for coupling two switch apparatus together in an enclosure, with the double throw switch linkage configured to open one switch apparatus and close another switch apparatus with a single lever arm assembly. Other substitutions, modifications, changes and omissions may be made in the design, operating conditions and arrangement of the preferred and other exemplary embodiments without departing from the spirit of the present invention and as defined in the appended claims.

What is claimed is:

1. A double throw switch linkage for coupling two switch apparatus together in an enclosure, with each switch apparatus coupled to a switch mechanism having a switch mechanism lever arm, the double throw switch linkage comprising:

an actuator plate slidingly mounted to a sidewall of the enclosure with fasteners through a plurality of actuator plate slots defined in the actuator plate, with the actuator plate also defining a first switch slot, a second switch slot and a driver arm slot, with each switch slot configured to guide a pin mounted on each switch mechanism lever arm; and a lever arm assembly mounted on a side wall of the enclosure, with the lever arm assembly including a lever arm coupled to a driver arm, with the driver arm configured to engage the driver arm slot in the actuator plate, wherein movement of the lever arm translates a force to the actuator plate which closes one switch apparatus and maintains the other switch apparatus in an open position.

2. The double throw switch linkage of claim 1, including an interlock release mechanism configured to release a cover of the enclosure if one of the switch apparatus is closed.

3. The double throw switch linkage of claim 2, wherein the interlock release mechanism includes an interlock bar coupled to each of the switch apparatus.

4. The double throw switch linkage of claim 1, wherein the actuator plate is composed of two members coupled together with the lever arm assembly.

5. The double throw switch linkage of claim 1, wherein the actuator plate is composed of a material selected from a group including a metal, a plastic, a composite material, and any two of the materials.

6. An electric double switch comprising:

an enclosure having at least one sidewall, a bottom wall and a cover;

a first switch apparatus, including a first switch mechanism having a lever arm, mounted in the enclosure;

a second switch apparatus, including a second switch mechanism having a lever arm, mounted in the enclosure; and a double throw switch linkage coupled to each of the first and second switch apparatus, the double throw switch linkage comprising:

an actuator plate slidingly mounted to the sidewall of the enclosure with fasteners through a plurality of actuator plate slots defined in the actuator plate, with the actuator plate also defining a first switch slot, a second switch slot and a driver arm slot, with each switch slot configured to guide a pin mounted on each switch mechanism lever arm; and a lever arm assembly mounted on a side wall of the enclosure, with the lever arm assembly including a lever arm coupled to a driver arm, with the driver arm configured to engage the driver arm slot in the actuator plate, wherein movement of the lever arm translates a force to the actuator plate which closes one switch apparatus and maintains the other switch apparatus in an open position.

7. The double throw switch linkage of claim 6, including an interlock release mechanism configured to release the cover of the enclosure if one of the switch apparatus is closed.

8. The double throw switch linkage of claim 7, wherein the interlock release mechanism includes an interlock bar coupled to each of the switch apparatus.

9. The double throw switch linkage of claim 6, wherein the actuator plate is composed of two members coupled together with the lever arm assembly.

10. The double throw switch linkage of claim 6, wherein the actuator plate is composed of a material selected from a group including a metal, a plastic, a composite material, and any two of the materials.

11. A method for interlocking two switch apparatus mounted in an enclosure, with each switch apparatus having a switch mechanism including a switch mechanism lever arm and the enclosure having a cover and a sidewall, the method comprising the steps of:

providing an actuator plate, with the actuator plate defining a first switch slot, a second switch slot and a driver arm slot, with each switch slot configured to guide a pin mounted on each switch mechanism lever arm;

mounting the actuator plate, for sliding movement, on the sidewall of the enclosure;

aligning the pin on each switch mechanism lever arm in one of the first and second switch slots in the actuator plate;

mounting a lever arm assembly on the sidewall of the enclosure, with the lever arm assembly including a lever arm coupled to a driver arm;

aligning the driver arm to engage the driver arm slot in the actuator plate; and moving the lever arm to translate a force to the actuator plate wherein one switch apparatus is closed and the other switch apparatus is maintained in an open position.

12. The method of claim 11, including the steps of providing an interlock release mechanism coupled to the cover and each of the switch apparatus, wherein the cover can be opened if one of the switch apparatuses is closed.

13. The method of claim 11, wherein the actuator plate is composed of a material selected from a group including a metal, a plastic, a composite material, and any two of the materials.

14. The method of claim 11, wherein the actuator plate is composed of two members and includes the step of coupling the two actuator plate members together with the lever arm assembly.

* * * * *